United States Patent [19]

Chen

[11] Patent Number: 4,989,480

[45] Date of Patent: Feb. 5, 1991

[54] SCREW DRIVER OF REPLACER FOR THE DRIVING HEAD

[76] Inventor: Ming-Tang Chen, No. 23-4, Alley 21, Lane 205, Yong Xing Road, Taichung, Taiwan

[21] Appl. No.: 393,731

[22] Filed: Aug. 15, 1989

[51] Int. Cl.[5] ..... B25B 23/00

[52] U.S. Cl. ..... 81/439; 81/177.4

[58] Field of Search ..... 81/437–440, 81/177.4, 490

[56] References Cited

U.S. PATENT DOCUMENTS 4,572,038 2/1986 Graham ..... 81/439

4,653,356 3/1987 Golden ..... 81/439 X

*Primary Examiner*—D. S. Meislin

*Attorney, Agent, or Firm*—Browdy and Neimark

[57] ABSTRACT

A screw driver device having a replaceable driving head comprising a hollow driving rod which has a pistol-like handle and a clamper for clamping the driving head. A wheel is inserted into the pistol-like handle and which contains driving heads of several types and is turnable with outside force a light for illumination of the work site is provided. In use, it requires to revert the driving rod with its clamper facing upward and turn and wheel to search a suitable driving head and get it faced direct with a slideway in the driver rod and then revert back the driving rod; thus, the chosen driving head may disengage itself from the wheel by its own gravity or by a striker's striking force the head can run down the slideway to protrude from the clamper. Locking the clamper makes it ready for use.

3 Claims, 5 Drawing Sheets

A–A SECTION

SCREW DRIVER OF REPLACER FOR THE DRIVING HEAD

FIELD OF THE INVENTION

The invention relates to a screw driver having a replaceable driving head, and particulary to a screw driver whose driving rod contains some driving heads of different sizes. The user may replace the original driving head with ease when he encounters different screw to deal with. It not only brings convenience in attaining proper instrument but also save the user's time in unnecessary search for a proper screw driver.

BACKGROUND OF THE INVENTION

Presently, the screw driver is widely used and is indispensable in nearly every business and family. However, the screws, screw bolts, and flutes of the screws applied to the articles are varied in sizes or types. The screw drivers to have to be provided in full sets, each set of which is distinguished with screw drivers of the specific sizes or types to meet the specific screw. Yet to non-professional members such as in a family, such complete set provision is unlikely, so there arises occasions where some screws will to be difficult to handle.

Assembled screw drivers are known in the market which bring full sets to the non-professional members. The devices use a driving rod whose front end is provided with a clamper to clamp driving head and which is packed with some driving heads in different sizes or types, altogether as a full set. In use, it needs to get the chosen driver head locked inside the clamper. However, because of small dimension of the driving head, there is still drawback that it is easy to get lost and hard to find.

OBJECT OF THE INVENTION

In view of the above-described problem, the present invention provides a screw driver with a replaceable driving head, in which there are features:

1. A wheel which contains some driving heads of different sizes is made of transparent material or has indications shown on its surface to facilitate the user in choosing a suitable driving head.

2. Replacing the original driving head with a new one is done always within the driving rod without any worry of loosing it.

3. A hollow driving rod auxiliary handle is provided to the store the spare wheel and some driving heads of particularity and to stablize the driving rod during operation, so that the screw flutes can be prevented from being damaged and operation becomes easier.

SUMMARY OF THE INVENTION

A screw driver with a replaceable driving head comprises: a driving rod which has a pistol-like handle and a clamper to clamp driving a head, a wheel which contains different driving heads is inserted into the pistol-like handle and is turnable with outside force, an auxiliary handle which assists in positioning for operation, and a light which provides illumination in work site. By turning the wheel, when the driving rod has its clamper facing upward, searching for a suitable driving head and aligning it with a slideway inside the rod and then pointing the rod, downward the chosen driving head will disengage itself from the wheel and run down toward the clamper to protrude from it, locking the clamper makes it use ready.

SPECIFIC DESCRIPTION

Figure 1:
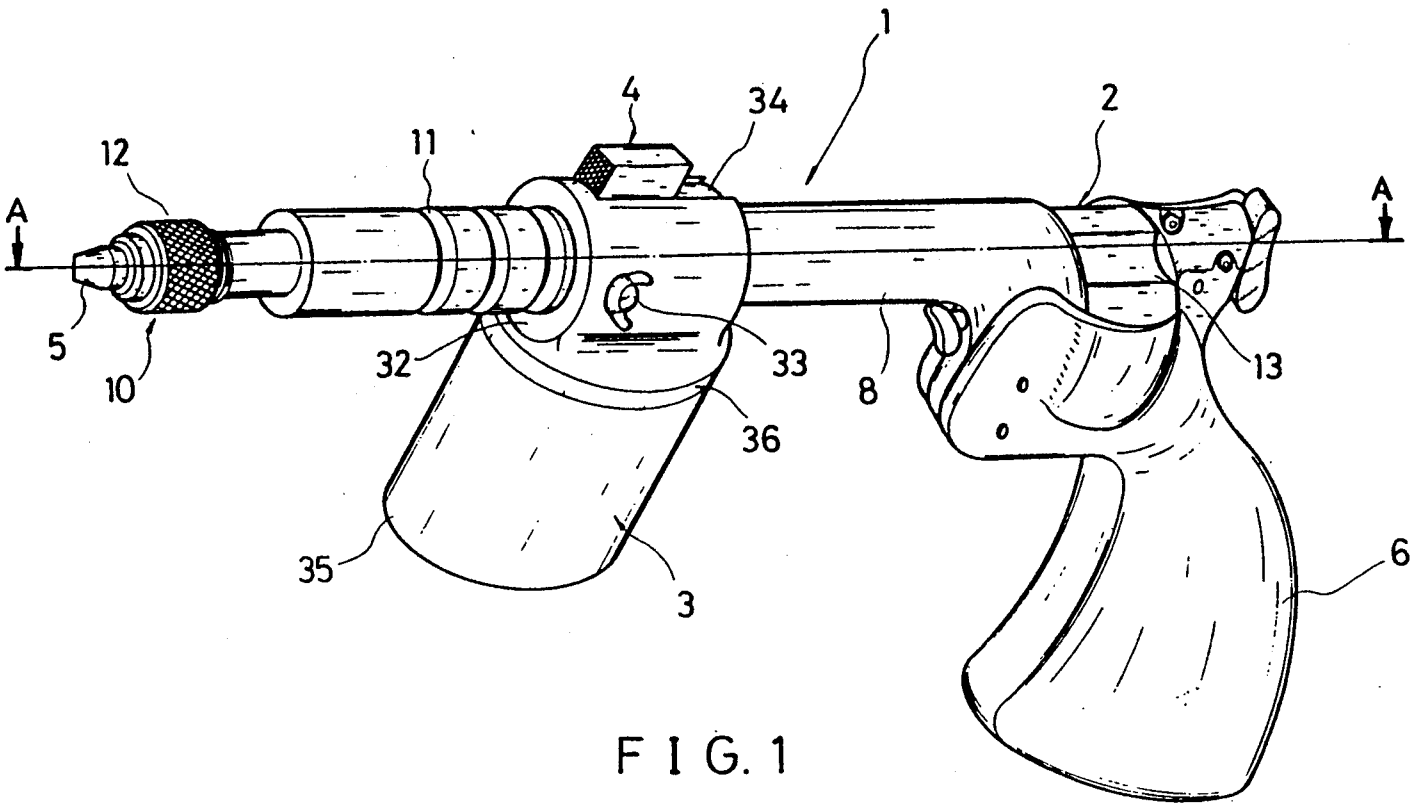
FIG. 1 is an appearance perspective view of a preferred embodiment according to the invention.
Figure 2:
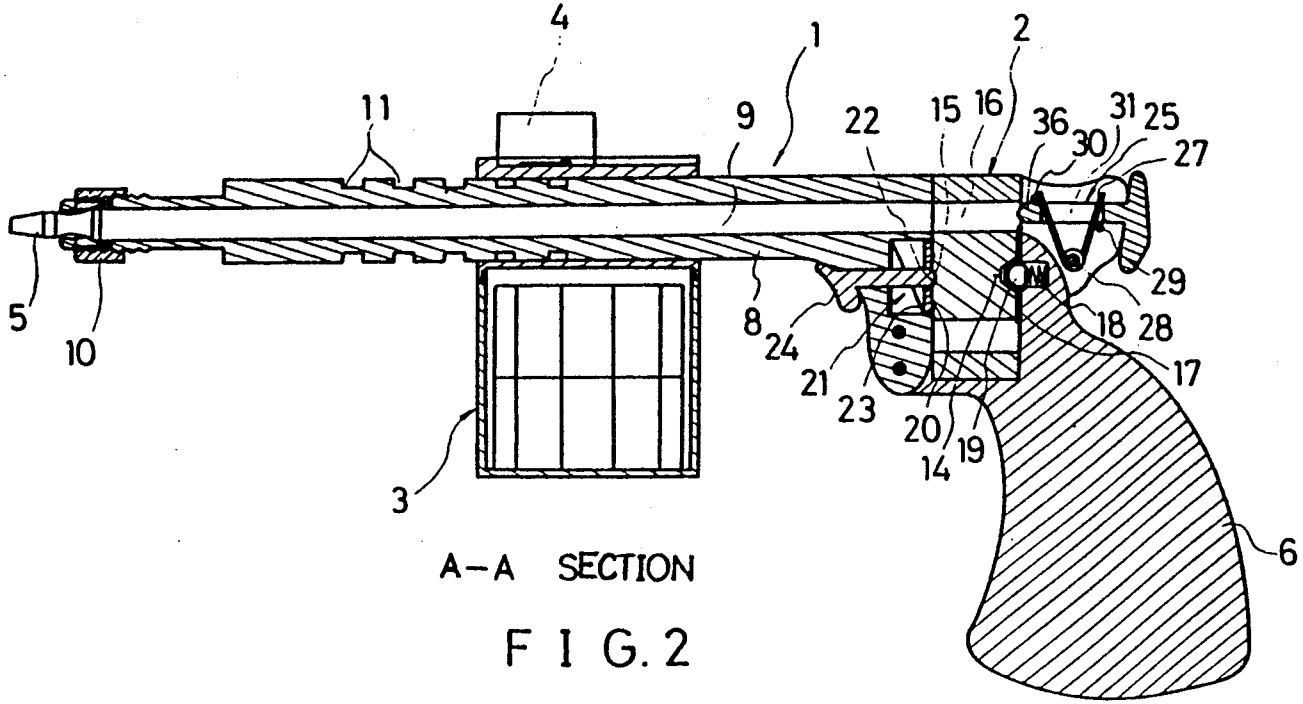
FIG. 2 is a sectional side view taken along A—A line of FIG. 1.
Figure 3:
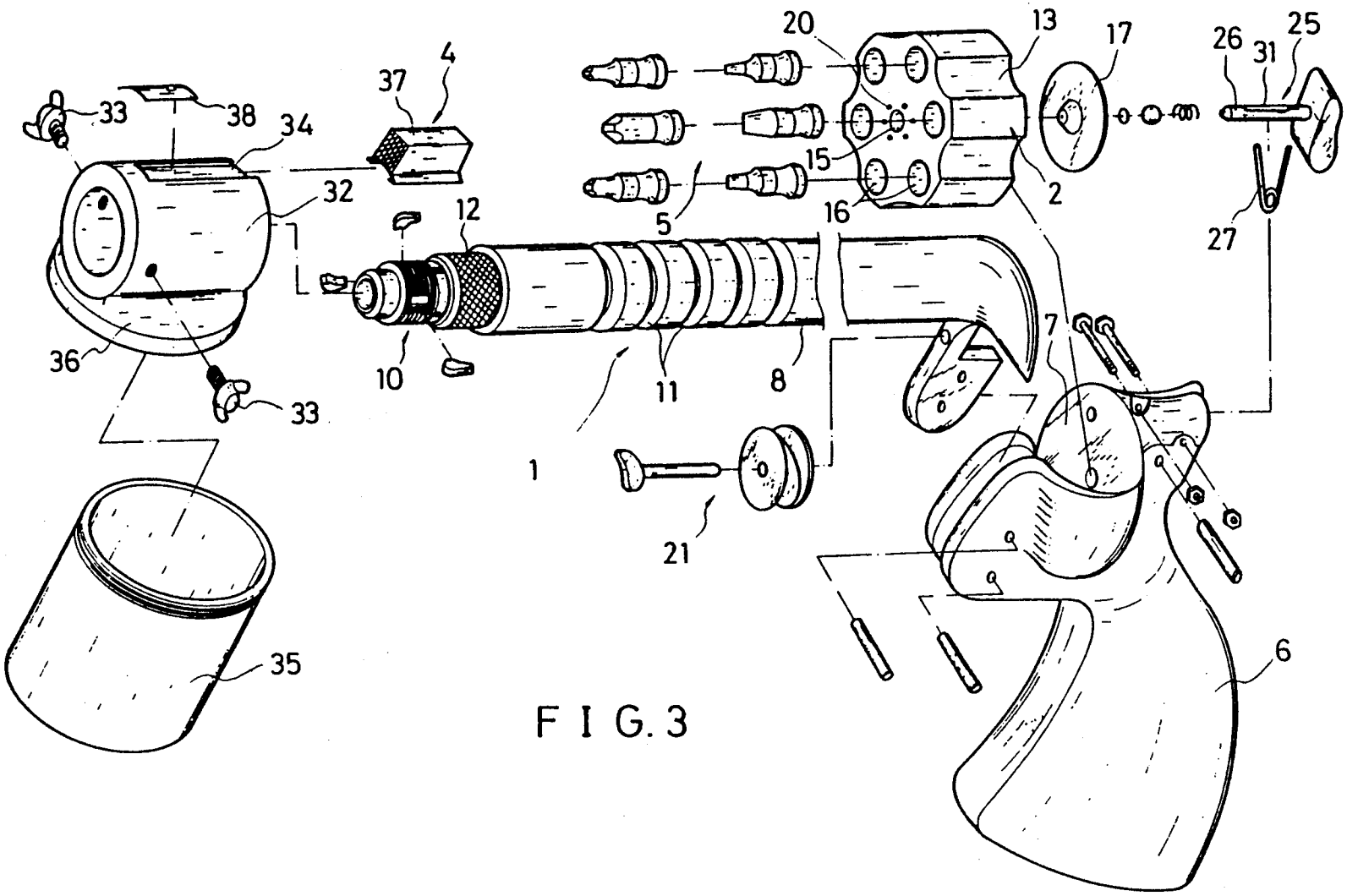
FIG. 3 is an exploded view showing construction of FIG. 1.
Figure 4:
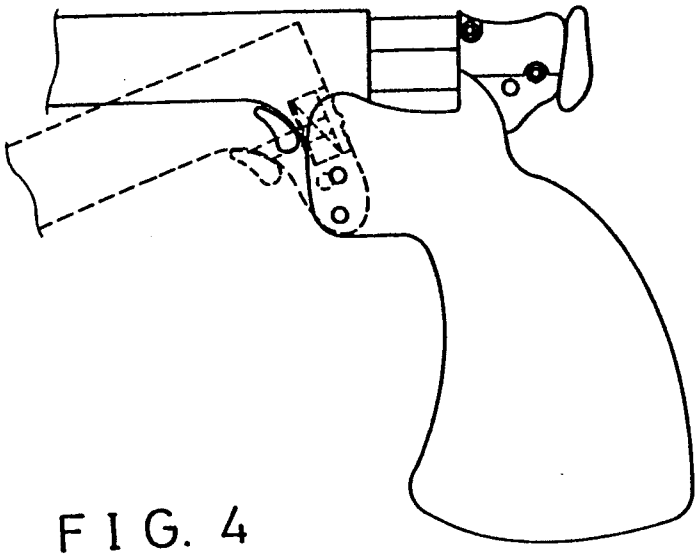
FIG. 4 is an outlined view of FIG. 1, showing the driving rod is moveable.

First referring to FIGS. 1, 2 and 3, the invention comprises: a driving rod 1 which can clamp driving heads and which is provided with a pistol-like handle, a wheel 2 which containing different driving heads is inserted into the pistol-like handle and is turnable with outside force, an auxiliary handle 3 which assists in positioning for operation, and a light 4 which provides illumination in work site. In the upper part of pistol-like handle 6, there is provided a U-shaped nest 7 in cross direction to accomodate wheel 2. In connection with the nest 7 front part, the rod body 8 of driving rod 1 is provided of a slideway 9 in its body center for the driving head 5 to pass to the rod front end of clamper 10 wherein the driving head 5, after disengaged from wheel 2 to run down slideway 9 by its own gravity or a striking force, may protrude from clamper 10 to be positioned there. In order to hold auxiliary handle 3, there are some annular flutes 11 provided in the periphery of rod body 8. Clamper 10, at the rod body 8 front end, holds the rear part of the protruded driving head 5, can be locked securely by screw 12.

As FIGS. 1,2 and 3 show, wheel 2 is a cylindrical block made of transparent material or having indications shown on its surface to reveal what types of the driving heads are contained therein. The wheel periphery is shaped with some arc flutes 13 with which the user may easily use his hand to turn the wheel to search for the driving head he needs and to get it faced right to the slideway 9 of rod body 8. At center of the two side faces of wheel 2 are depressions 14, 15, and around depressions 14, 15, there are provided driving head-containing holes 16 equally distanced and angled in arrangement. And to prevent the driving head 5 from slipping out of the driving head-containing hole 16, there is fender 17 provided to connect with the real face of wheel 2, with which the holes 16 could be partially fended. After being loaded with driving heads 5, wheel 2 is to be placed into U-shaped nest 7 whose rear opening is stuffed with spring 18 and steel pearl 19 which meets the wheel's concavity of connection 14. The front opening, 22 contains a resilient pin 21, which meets the connection 15. Around connection 15, there are provided pits 20 same in number as driving head-containing hole 16 on the wheel front face. Resilient pin 21 is made by using a spired plate whose center is set with a pine 22. Pin 22 is provided with a raised point 23 at one end, which has adaption to the pit 20 on wheel 2, and has a controller 24 connected at its other end. When wheel 2 is turned by hand to search for a suitable driving head, the raised point 23 of pin 22 will be inserted into the pit 20 to stay and send out a sound. And when wheel 2 is to be removed, it only requires removing the driving rod 1 with its clamper facing upward and then pulling controller 24 to compress the spired plate; pin 22 moves backward disengaging itself from the concavity of connection 15 and, wheel 2 may be easily taken out. During turning of the wheel, each driving head-containing hole 16 may come in alignment with the slideway 9 of of the rod body 8 of driving rod 1, so driving head 5 can enter into slideway 9 smoothly. Along the central, protracted line of slideway 9, there is arrangement of a striking means 25 for the driving head 5, which consists of striker 26, V-shaped spring 27, and positioning pins 28, 29, 30 in handle 6. Striker 26 is made of a needle-like body, having a section of fluted passage 31 cut to interlink the upper part of spring 27 which is shaped of "V" by means of positioning pin 28. The V-shaped spring 27, after being pulled to restore power, when released will drive striker 26 to strike the driving head 5 away from the hole 16 the head is resting in, and then by its own gravity, the driving head 5 will fall down slideway 9 to the clamper 10 automatically.

Figure 5:
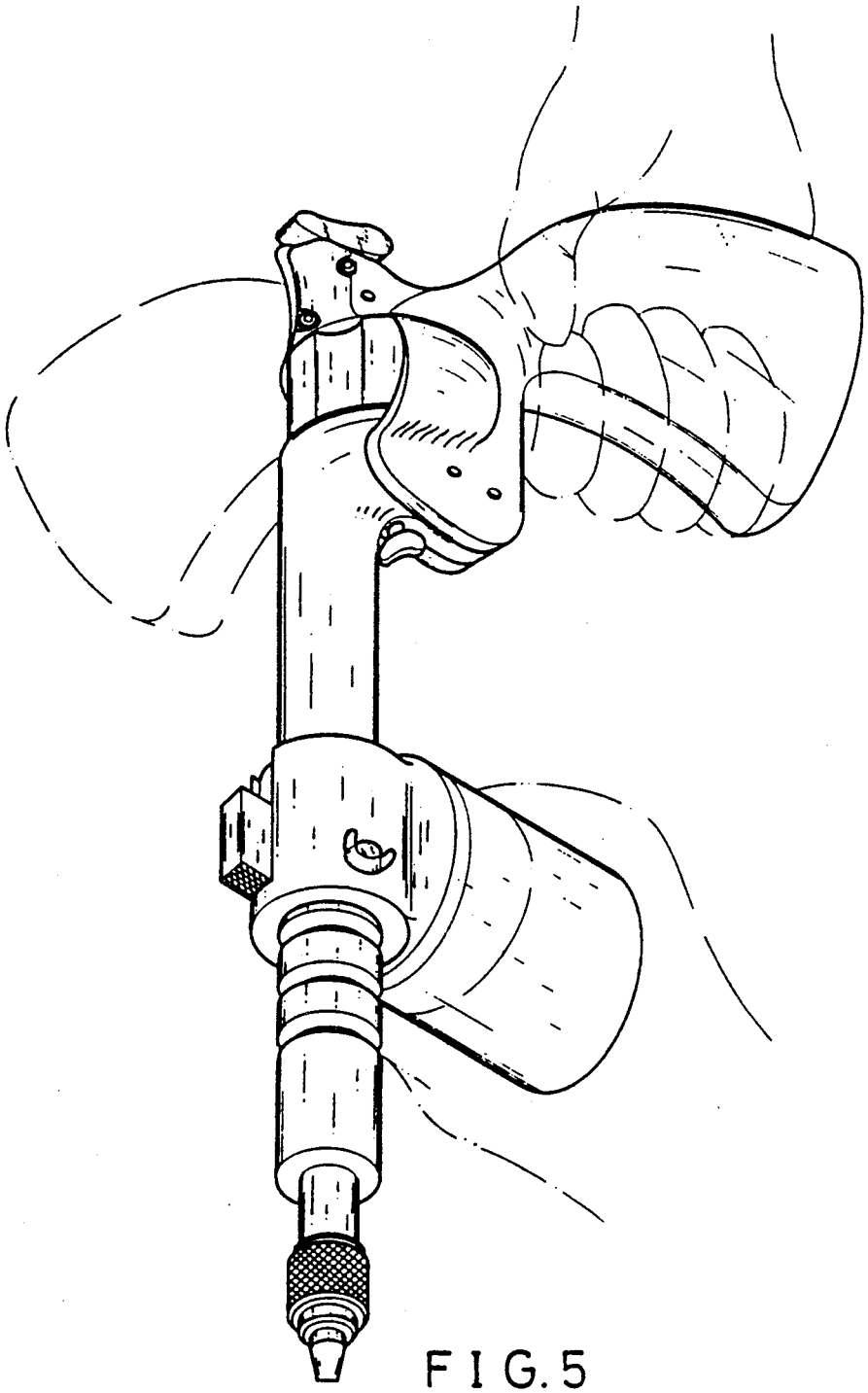
FIG. 5 shows the invention ready at use.

As shown in FIGS. 1, 2, and 3, auxiliary handle 3 is in hollow, cylindric form, and utilizes a sleeve barrel 32 to join rod body 8 by means of two winged screws 33 securely screwing it against the annular flutes 11 in position. To hole light 4, there is seat 34 in sleeve barrel 32, and on the opposite side against seat 34, there is union base 36 provided with which holds body 35. Hold body 35 is a hollow, one-side-sealed barrel, which contains a spare wheel and driving heads. In use of the invention (as FIG. 5 shows) body 35 held by the user's other hand and will stabilize rod body 8 in its direction against screw head so as to prevent driving head 5 from harming it. In light 4, body 37 is dovetailed of at its bottom and has two touching points therein; seat 34 is dovetailed too for adaption and has a conducting copper plate 38 connected for contact with the two touching points. Light 4 is in the "ON" state when the touching points are contacted. Otherwise, it will would be switched to "OFF" state. In replacing driving head 5, the user firstly has to point driving rod 1 with its clamper 10 facing upward and turn wheel 2 to have a vacant hole 16 of vacancy faced toward slideway 9, and then loosen the clamper 10 and press down driving head 5 which then by means of its own gravity will fall down slideway 9 back to the vacant hole 16 to stay to find a suitable driving head, the user only needs to turn wheel 2 and have the chosen driving head direct in line with slideway 9 and point back down driving rod 1 with its clamper 10 facing downward. At that time the chosen driving head 5 by means of its own gravity will disengage itself from hole 16 and run down slideway 9 to the clamper 10 with its fore part protruding out. Screwing tight the clamper 10 makes it use ready. If the chosen driving head 5 still stays in its hole 16, striking means 25 may be used to give it a striking push to force disengagement. In operation, as shown in FIG. 5, two hands are used, this way not only to stablize operation but also conserve strength, and not to harm screw head so easily. Light 4 can be used to provide illumination for the work site. In all, this screw driver having a replaceable driving head brings more convenience to the user and has features of improvement indeed.

I claim:

1. A screw driver having a replaceable driving head, which comprises:

a driving rod, which has a clamper to clamp said driving head at its front end and which has a pistol-like handle in a rear part, wherein a U-shaped nest is cut out of said handle rear part in cross direction to accommodate a wheel which contains driving heads of different types;

a front part of the wheel connected to a rod body of said driving rod, said driving rod having a slideway provided in its center for the driving head to pass all the way to a rod body front end where it is to be clamped;

annular flutes are provided on a rod body outer face for adjustably holding an auxiliary handle;

a striking means provided behind said wheel along a central, projected line of the said slideway, which comprises a striker which is connected to a v-shaped spring and positioning pins for holding said spring to said screw driver;

a wheel having two side faces, containing different driving heads is rotatably attached to said U-shaped nest in said pistol-like handle and said wheel being turnable by an outside force, and is held in position inside said U-shaped nest by a concave connection provided on said wheel having equally distanced angle pits and holes containing driving-heads wherein during turning of the wheel, a central projected line of each of the holes containing driving heads will fall in alignment with that of the slideway of said rod body;

a fender connected to the wheel rear face, which partially fends the driving head-containing holes;

a, hollow cylindrical holding body connected to a sleeve barrel, wherein said sleeve barrels connected to aforesaid rod body for positioning the screw driver during operation;

a seat on one side of said sleeve barrel for holding a light while a union base on the opposite side is connected to the holding body;

said holding body being a one-side-sealed barrel which contains spare wheel and driving heads;

a light on said seat which provides illumination to the work site;

different driving heads, which are to be contained in the aforesaid wheel;

wherein said screw driver when pointed with its clamper up, offers a choice of different driving heads by turning the wheel;

when the screw driver is pointed downward, a chosen driving head will protude from the clamper and will be ready for use when locked.

2. The screw driver of claim 1 wherein said wheel has a cylindrical block made of transparent material.

3. The screw driver of claim 1 wherein said wheel has a cylindrical block having indications regarding the types of driving heads contained therein on its outer face.

* * * * *